US006106410A

United States Patent [19]

Glod et al.

[11] Patent Number: 6,106,410

[45] Date of Patent: Aug. 22, 2000

[54] GOLF CLUB IRON HEAD HAVING LIFT-OFF SOLE

[75] Inventors: David B. Glod, Bloomfield Hills, Mich.; Mark C. Myrhum, Phoenix, Ariz.

[73] Assignee: Tour Edge Golf Manufacturing, Inc., St. Charles, Ill.

[21] Appl. No.: 09/275,862

[22] Filed: Mar. 18, 1999

[51] Int. Cl.[7] ..... A63B 53/04

[52] U.S. Cl. ..... 473/290; 473/328; 473/350

[58] Field of Search ..... 473/324, 325, 473/327, 328, 329, 345, 347, 348, 349, 350, 287, 290, 291, 292; D21/747, 748, 749, 750, 751, 752

[56] References Cited

U.S. PATENT DOCUMENTS

| | | |
|---|---|---|
| D. 343,434 | 1/1994 | Helmstetter et al. . |
| D. 352,984 | 11/1994 | Helmstetter et al. . |
| 1,868,286 | 7/1932 | Grieve . |
| 3,079,157 | 2/1963 | Turner . |
| 3,761,095 | 9/1973 | Thompson . |
| 3,961,796 | 6/1976 | Thompson . |
| 4,162,794 | 7/1979 | Thompson . |
| 4,313,607 | 2/1982 | Thompson . |
| 4,319,752 | 3/1982 | Thompson . |
| 4,854,580 | 8/1989 | Kobayashi . |
| 5,180,166 | 1/1993 | Schmidt et al. . |
| 5,240,252 | 8/1993 | Schmidt et al. . |
| 5,301,945 | 4/1994 | Schmidt et al. . |
| 5,377,983 | 1/1995 | Fenton . |
| 5,419,556 | 5/1995 | Take . |
| 5,460,376 | 10/1995 | Schmidt et al. . |
| 5,470,068 | 11/1995 | Schmidt et al. . |
| 5,470,069 | 11/1995 | Schmidt et al. . |
| 5,474,297 | 12/1995 | Levin . |
| 5,480,152 | 1/1996 | Schmidt et al. . |
| 5,484,155 | 1/1996 | Yamawaki et al. . |
| 5,486,000 | 1/1996 | Chorne . |
| 5,603,668 | 2/1997 | Antonious . |
| 5,611,741 | 3/1997 | Schmidt et al. . |
| 5,695,412 | 12/1997 | Cook . |
| 5,800,281 | 9/1998 | Gilbert . |
| 5,971,866 | 10/1999 | Adams . |

*Primary Examiner*—Sabastiano Passaniti
*Attorney, Agent, or Firm*—Gregory Garmong

[57] ABSTRACT

A golf club iron has a metallic club head including a solid metallic club head body with a bottom surface including a sole that contacts a flat surface when the bottom surface of the club head is placed onto a flat surface, a top surface, a hosel extending from the club head body, and a front face on the club head body. The heel and toe of the club are angled upwardly from a trailing edge central sole region, so that a central sole region has a length of from about ¼ inch to about ¾ inch to reduce the potential contact area of the club head with the ground. There is a recess in the rear face of the club head body, with a rim around the recess having a thickness of from about 5/16 inch to about 1 inch measured in the central portion of the rear face of the club head body, to lower the center of gravity of the club head. The angle between a tangent plane to the bottom surface and a ground plane lying perpendicular to the axis of the hosel is about equal in degrees to the club head designation number, producing an increased bounce angle of the club head.

15 Claims, 2 Drawing Sheets

FIG. 4
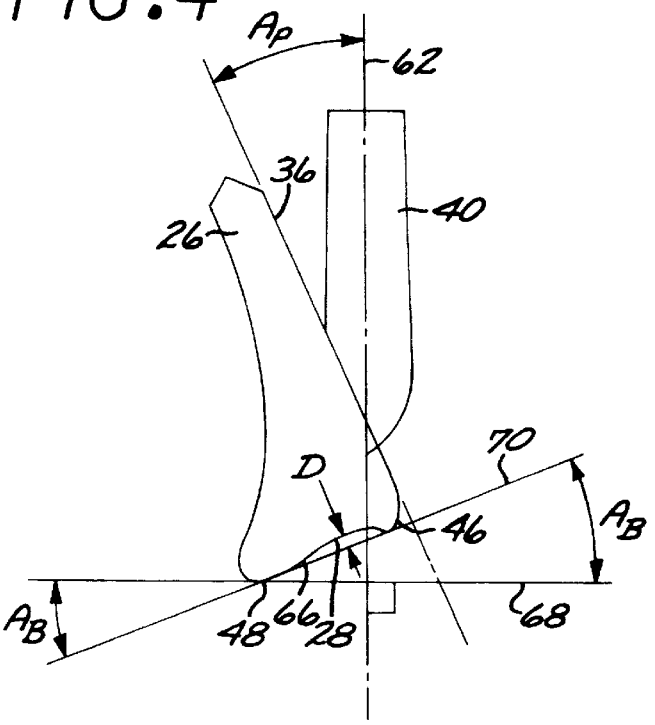
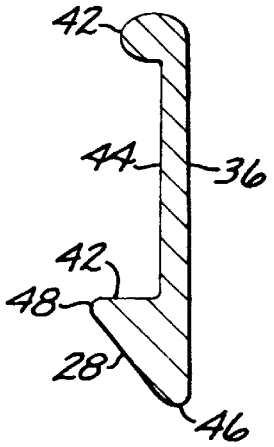
FIG. 6
FIG. 5
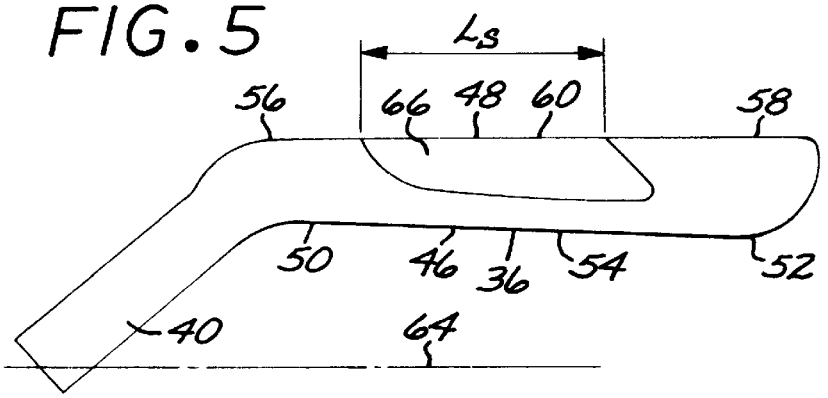
FIG. 7
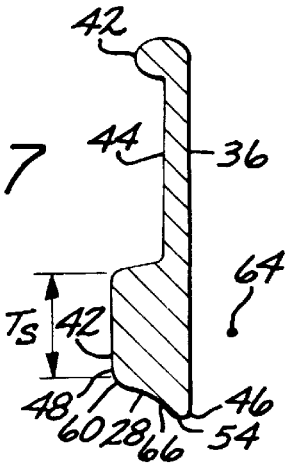
FIG. 8
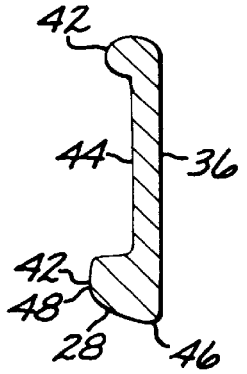

GOLF CLUB IRON HEAD HAVING LIFT-OFF SOLE

BACKGROUND OF THE INVENTION

This invention relates to an iron golf club, and, more particularly, to an iron golf club having improved ball control.

In the game of golf, a golf club is swung by the golfer to impact a golf ball. The golf club has a head which impacts the golf ball, and a shaft that is grasped and swung by the golfer. There are three basic types of clubs, divided primarily according to the type of head and circumstances of hitting the golf ball: wood clubs to hit the golf ball long distances from an elevated tee; irons to hit the golf ball shorter, more controlled distances with controlled elevations; and putters to hit the golf ball for a short distance along the ground with a high degree of control. The present invention relates to irons, and does not relate to wood clubs or putters. (The term "iron" is a term of art referring to the design of the club, and does not refer to the material of construction.)

The golfer usually has a set of irons which vary according to the loft angle of the face of the golf club relative to the shaft, with increasing designation numbers being associated with increasing loft angles. The selection of the iron to be used depends upon the distance that the golf ball is to be hit and the degree to which the golfer desires back spin on the ball to halt forward roll. In each case, however, the golf ball lies on the ground and the golf club is swung with a high velocity so that the club head impacts the ball with high force. This use of the iron golf club distinguishes the use of the wood club, where the golf ball is usually hit from an elevated tee so that there is less contact of the underside of the club head with the ground, and the putter, where the velocity of the swing is relatively small.

A front face of the iron golf club head impacts the golf ball lying on the ground either squarely or slightly under the golf ball to project the golf ball on an upward trajectory. The bottom side of the iron club head, which is slightly convexly curved, either grazes the surface of the ground, which may be grass, turf, sand, preexisting divots, or the like, or actually digs into the ground slightly when the golf ball is struck.

The passage of the bottom side of the club head across the surface of the ground typically creates a substantial amount of retarding force on the club head, due to either or both of two reasons. First, the ground itself may have a texture, such as relatively high grass, that generates friction with the passage of the bottom side of the club head. Second, the highly skilled golfer, such as the professional, can usually control with great precision the vertical location of the club head and thence the degree of contact with the ground. The less-skilled golfer, on the other hand, has somewhat less control and may cause the bottom side of the club head to contact the ground with greater force than desired.

The retarding force generated between the bottom side of the swung iron and the ground affects the flight of the golf ball in two ways. First, it reduces the velocity of the club head and thence the force transmitted to the golf ball. The result is a shorter flight distance. Second, if the force is not symmetric, it can cause the club head to rotate slightly at the time of impact, with the result that the ball is hit in a direction slightly different from that desired. Both of these results are undesirable. Additionally, it is important to control the flight path of the ball responsive to the problem presented to the golfer.

The ground effects on golf club iron hitting performance are reduced with increasing skill of the golfer. However, for all golfers, there is a need for an iron club which, by the design of the club head, reduces the likelihood of adverse ground effects on hitting performance and also optimizes the hitting performance of the club. The present invention fulfills this need, and further provides related advantages.

SUMMARY OF THE INVENTION

The present invention provides a golf club iron having a head which reduces the ground retarding force experienced by the club and the head during a swing. The retarding force that is present is largely centered along the trajectory of the swing, reducing the rotational forces that tend to twist the club head and cause the golf ball to travel away from its intended path. To the contrary, the retarding forces, being centered along the trajectory of the swing, serve as a "rudder" to aid in holding the club head in the proper path. The club head therefore has improved performance in hitting and extracting a golf ball that is in deep grass or turf. Increased mass is moved into the lower portion of the iron club head, improving the control over the elevational angle to which the golf ball is hit.

In accordance with the invention, a golf club iron comprises a metallic club head including a solid metallic club head body having a bottom surface with a heel (i.e., inner margin) and a toe (i.e., outer margin), a top surface, and a hosel extending from the club head body at a location adjacent to the heel of the bottom surface and having a hosel axis. A front face on the club head body is inclined at a loft angle to the hosel axis and has a continuously convexly curved lower leading edge along the intersection of the bottom surface and the front face. The lower leading edge extends from the heel to the toe of the bottom surface and includes a leading edge inner region adjacent to the heel, a leading edge central sole region, and a leading edge outer region adjacent to the toe. There is, additionally, a lower trailing edge on the club head body having a trailing edge central sole region lying substantially parallel to the leading edge central sole region, a trailing edge inner region tapered upwardly toward the top surface from the trailing edge central sole region toward the heel of the bottom surface, so as to be not parallel with the leading edge inner region, and a trailing edge outer region tapered upwardly toward the top surface from the trailing edge central sole region toward the toe of the bottom surface, so as to be not parallel with the leading edge outer region.

Stated alternatively, a golf club iron comprises a metallic club head including a solid metallic club head body having a bottom surface including a sole that contacts a flat surface to within a clearance of about ¼ of an inch when the bottom surface of the club head is placed onto a flat surface. The club head further includes a top surface, a hosel extending from the club head body, and a front face on the club head body. The front face has a continuously convexly curved lower leading edge along the intersection of the bottom surface and the front face. The length of the sole measured in a longitudinal direction lying in the sole and parallel to the front face is from about ¼ to about ¾ inch. In either of these embodiments, there is preferably a shaft affixed to the hosel.

A further feature is that the bottom surface is concavely curved between the leading edge central sole region and the trailing edge central sole region, across the width of the sole. With this concave curvature, only the leading edge central sole region and the trailing edge central sole region touch the ground. It is not necessary that the intermediate region of the sole actually touch the ground. The result is a very small contact area—the two central sole regions only over the relatively short longitudinal dimension of the sole—that touch the ground and retard the golf club head during a swing wherein the head touches the ground. As noted, because this contact area is centered along the trajectory of the swing, the retarding forces which do occur do not tend to cause the club head to rotate. If the club head does rotate, the retarding forces tend to restore it to the proper orientation, thereby acting as a "rudder".

The bounce angle of the club is the angle between the bottom surface of the club head and the ground plane. The club head is configured so that the bounce angle of the iron clubs of the invention is about equal to the iron club head designation number, or about 2 degrees greater than the maximum bounce angle for conventional irons.

For a standard iron club, the loft angle is from about 17 degrees to about 60 degrees, with the exact value dependant upon the iron designation. The width of the bottom surface between the leading edge central sole region and the trailing edge central sole region is no greater than about 1 inch. The club head has a weight of from about 215 to about 305 grams.

The club head has a sole portion of a back side rim that is from about 5/16 inch to about 1 inch thick, as distinct from conventional irons which have, at most, a sole portion less than ¼ inch thick. Optionally, an additional weight may be inserted into this sole portion. Both the thicker sole portion and the added weight lower the vertical center of gravity of the club head.

The club head of the invention has a conventional front face where the impact with the golf ball occurs. The club head is therefore readily utilized by golfers accustomed to playing with the conventional club head.

This combination of features of the iron club head of the invention achieves both reduced drag and better control of the club swing trajectory, and also better control of the flight path of the struck ball, as compared with conventional iron clubs. A golf ball embedded in heavy turf may be more readily extracted with this design than with conventional club heads. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 4 is an end view of the golf club head of FIG. 2;

FIG. 5 is a bottom view of the golf club head of FIG. 2;

FIG. 6 is a sectional view of the golf club head of FIG. 2, taken along lines 6—6;

FIG. 7 is a sectional view of the golf club head of FIG. 2, taken along lines 7—7; and FIG. 8 is a sectional view of the golf club head of FIG. 2, taken along lines 8—8.

DETAILED DESCRIPTION OF THE INVENTION

Figure 1:
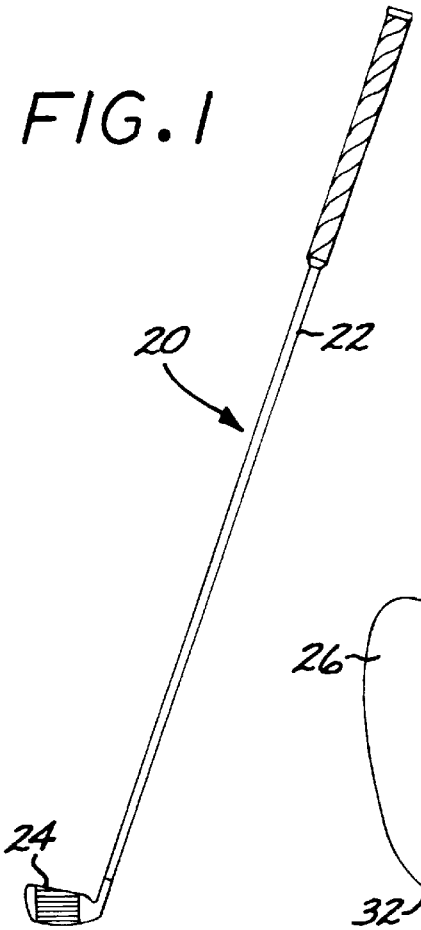
FIG. 1 is a perspective view of an iron golf club.
Figure 2:
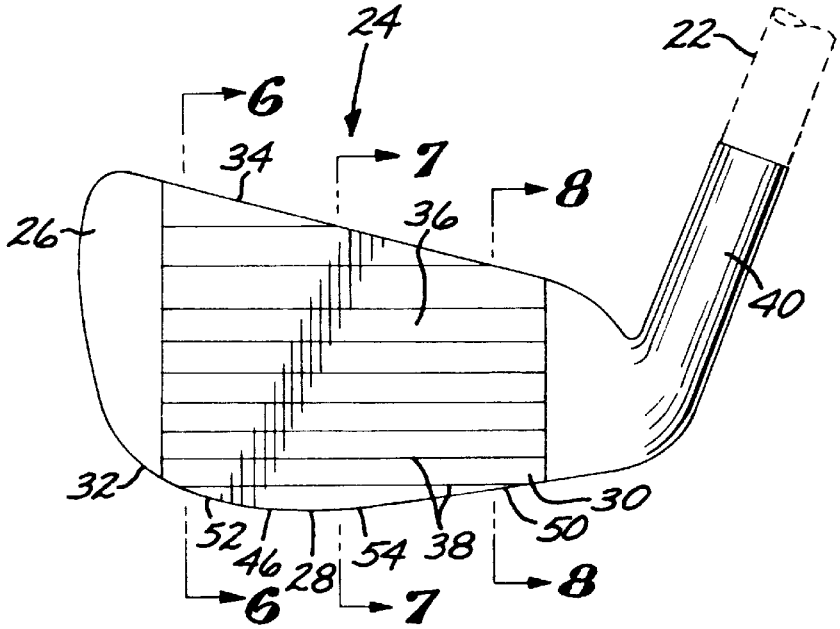
FIG. 2 is a front elevational view of a golf club iron head according to the invention.

FIG. 1 illustrates an iron golf club 20. The iron golf club 20 includes a shaft 22, and an iron golf club head 24 affixed to the shaft 22. The shaft 22 may be made of any of a variety of metals, composite materials, and wood known in the art. The iron golf club head 24 is made of a metal, such as steel or titanium alloy.

FIGS. 2–5 illustrate the overall structure of the iron golf club head 24 in greater detail. Referring to the front elevational view of FIG. 2, the iron golf club head 24 includes a solid iron club head body 26 having a bottom surface 28 with a heel 30 and a toe 32, and a top surface 34. (In FIG. 2, only the forward-most profile of the bottom surface 28 is visible, as will be discussed in greater detail subsequently.) The term "solid" as used herein means that the iron club head body 26 is not a thin-walled hollow shell, as in the case of wood club head bodies. The iron club head body 26 may have recesses or openings therein. A front face 36 of the iron club head body 26 is typically provided with a pattern 38 of generally horizontal small recesses that help to define the transfer of force from the iron golf club 20 to a golf ball when it is struck.

A hosel 40 extends from the iron club head body 26. The hosel 40 is a hollow tubular portion that is usually cast integrally with the iron club head body 26. The hosel 40 provides the attachment by which a tip of the shaft 22 is affixed to the iron club head body 26. The weight of the iron golf club head 24, including the iron club head body 26 and the hosel 40, is typically from about 215 to about 305 grams.

Figure 3:
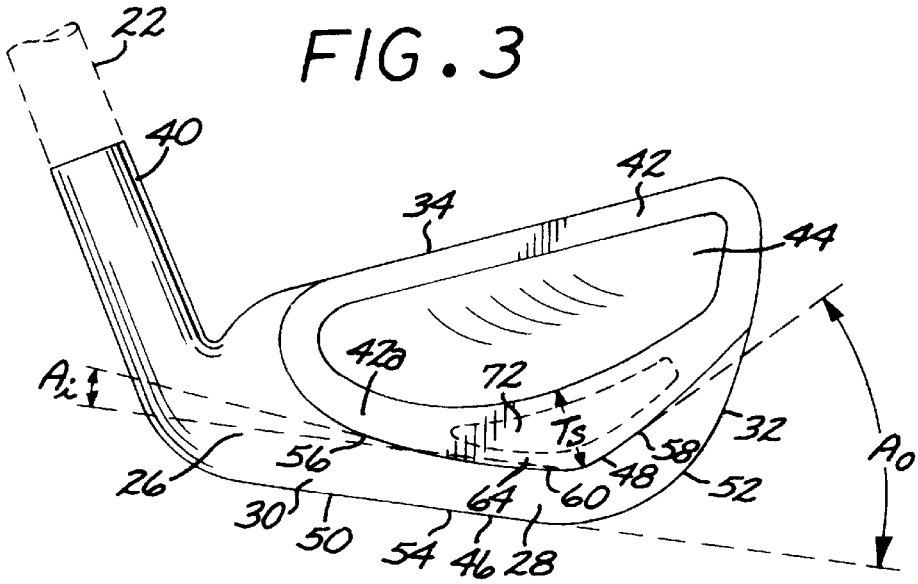
FIG. 3 is a rear elevational view of the golf club iron head of FIG. 2.

The opposing rear elevational view of the iron golf club head 24 is found in FIG. 3. The iron club head body 26 has a rim 42 defining a recess 44 (also sometimes termed a "back cavity") in general opposition to a central portion of the front face 36 of FIG. 2. The rim 42 has a sole portion 42*a* adjacent to the bottom surface 28 of the club head 24. The sole portion 42*a* of the rim 42 has a maximum thickness $T_S$, measured at the back surface, of from about 5/16 inch to about 1 inch. By comparison, the corresponding rim thickness at the sole portion of the rim (if any) of conventional clubs is about ¼ inch or less. Generally speaking, the effect of the thicker rim 42*a* at the sole is to lower the center of gravity of the club head. If $T_S$ is less than about 5/16 inch, there is an insufficient mass of material in the sole area to lower the center of gravity of the club to the desired small height above the bottom of the club head. Optionally, one or more inserts 72 of high-density metal, such as tungsten, lead, copper, or powdered metal combinations, may be inserted into and encapsulated within the sole portion 42*a*. The effect of increasing the thickness $T_S$ of the sole portion of the rim 42*a*, and of optionally adding the high-density insert 72, is to move the vertical center of gravity of the club head 24 downwardly toward the bottom surface 28. The lower vertical center of gravity aids in achieving a high angle to the flight path of the golf ball hit with the club head and more effectively extracting the ball from any grass condition.

As seen in FIG. 4, the bottom surface 28 defines a lower leading edge 46 at its intersection with the front face 36, and a lower trailing edge 48 at its rearward end. It is the lower leading edge 46 that is visible in FIG. 2, and both the lower leading edge 46 and the lower trailing edge 48 are visible in FIG. 3. The lower leading edge 46 may be further defined as having a leading edge inner region 50 adjacent to the heel 30, a leading edge outer region 52 adjacent to the toe 32, and a leading edge central sole region 54 between the leading edge inner region 50 and the leading edge outer region 52. Similarly, the trailing edge 48 may be further defined as having a trailing edge inner region 56 adjacent to the heel 30, a trailing edge outer region 58 adjacent to the toe 32, and a trailing edge central sole region 60 between the trailing edge inner region 56 and the trailing edge outer region 58. The regions 50 and 56, the regions 52 and 58, and the regions 54 and 60 are in general opposition to each other.

The leading edge central sole region 54 lies substantially parallel to the trailing edge central sole region 60. However, the trailing edge inner region 56 is tapered upwardly toward the top surface 34 from the trailing edge central sole region 60 toward the heel 30 of the bottom surface 28, so as to be not parallel with the leading edge inner region 50. An angle of taper $A_i$ is an acute external angle (that is, outside the volume of the material of the iron club head body 26) of the trailing edge inner region 56 relative to the leading edge inner region 50 and measured from the adjacent edge of the central sole region 60 to the midpoint of the trailing edge inner region 56. The angle $A_i$ is preferably from about 10 degrees to about 60 degrees, most preferably about 20 degrees, although the angle of taper $A_i$ may be varied according to the loft angle of the iron golf club head 24. The loft angle $A_p$ of the iron golf club head 24 is defined as the angle between the front face 36 and an axis 62 of the hosel 40, as seen in FIG. 4, and is typically from about 17 degrees to about 60 degrees for an iron golf club head 24. Similarly, the trailing edge outer region 58 is tapered upwardly toward the top surface 34 from the trailing edge central sole region 60 toward the toe 32 of the bottom surface 28, so as to be not parallel with the leading edge outer region 52. An angle of taper $A_o$ is an acute external angle (that is, outside the volume of the material of the iron club head body 26) of the trailing edge outer region 58 relative to the leading edge outer region 52 and measured from the adjacent edge of the central sole region 60 to the midpoint of the trailing edge outer region 58. The angle $A_o$ is preferably from about 10 degrees to about 60 degrees, most preferably about 30 degrees, although the angle of taper $A_o$ may be varied according to the loft angle of the iron golf club head 24.

A ground plane 70 is defined perpendicular to the hosel axis 62. A bounce angle AB is defined as the angle between the ground plane 70 and a bottom-tangent plane 68 lying tangent to the leading edge central sole region 54 of the lower leading edge 46, and to the trailing edge central sole region 54 of the lower trailing edge 48 of the bottom surface 28. In the present approach, the bounce angle $A_B$ is greater than for corresponding conventional clubs by about 2 degrees in each case. The following table summarizes the values of the bounce angle $A_B$ for COMP 950 irons made by Tour Edge Golf and for the irons of the present invention:

| Iron Club Designation | $A_B$, prior art, degrees | $A_B$, invention, degrees range and (preferred) |
|---|---|---|
| #1 | −1 | 0 to 2 (1) |
| #2 | 0 | 1 to 3 (2) |
| #3 | 1 | 2 to 4 (3) |
| #4 | 2 | 3 to 5 (4) |
| #5 | 3 | 4 to 6 (5) |
| #6 | 4 | 5 to 7 (6) |
| #7 | 5 | 6 to 8 (7) |
| #8 | 6 | 7 to 9 (8) |
| #9 | 7 | 8 to 10 (9) |
| Pitching Wedge, #10 | 8 | 9 to 11 (10) |
| MIDPW, #11 | 9 | 10 to 12 (11) |
| Sand Wedge, #12 | 12 | 13 to 15 (14) |

This increase in the bounce angle $A_B$ aids in extracting the impacted ball from abnormalities, as for example when the ball is in deep turf and the club head strikes the turf first before hitting the ball. Another result of the increased bounce angle is to increase the back spin imparted to the ball at impact, so that the ball tends to forwardly roll less upon landing. The increase in the bounce angle squares the club face at impact for the average player. Any bounce angle $A_B$ greater than zero closes the club face, producing better squaring of the club face.

The lowered center of gravity due to the increased value of $T_S$ and the increased bounce $A_B$, as well as the cut-away heel and toe, all cooperate to produce a heavier "rudder" effect than found in conventional clubs, so that the impacted ball flies higher from all types of turf conditions, and also makes a ball contacted low on the club face go the correct distance because there is more mass behind the contact point. The hitting performance of the club is thereby improved.

FIGS. 6–8 are sectional views through the iron club head body 26, at the toe 32, central sole region 54, 60, and heel 30, respectively. The bottom surface 28 at the toe 32 (FIG. 6) and the heel 30 (FIG. 8) may be of any operable shape, and is here illustrated as the preferred slightly convex shape. In the central sole region 54, 60 (FIG. 7), the bottom surface is preferably slightly concave relative to a longitudinal axis 64 (illustrated in FIG. 5) that is generally parallel to the leading edge central sole region 54 and the trailing edge central sole region 60.

The combination of the upwardly tapering of the bottom surface 28 on either side of the central sole region, by the previously described angles $A_i$ and $A_o$, and the bottom surface 28 extending between the leading edge central sole region 54 and the trailing edge central sole region 60, produces a generally flat, but slightly curved, sole 66. This sole 66 is the portion of the iron club head body 26 that extends the furthest downwardly when the iron golf club 20 is swung in a conventional fashion. The lateral extent of the sole 66 may be defined as the length $L_S$ (illustrated in FIG. 5) parallel to the longitudinal axis 64 that is within a distance D of about ¼ of an inch of a plane 68 when the iron club head body 26 is placed with the bottom surface 28 resting on the plane 68. This length $L_S$ is preferably from about ¼ to about ¾ inch, substantially shorter than the overall length of the bottom surface 28 of the iron club head body 26 in the direction parallel to the longitudinal axis 64.

Conventional iron golf club heads 26 are constructed so that substantially the entire length of the bottom surface extends downwardly sufficiently far to potentially contact the ground when the club is swung. In the present case, the length of the sole 66 is substantially shorter, resulting in less potential contact area of the bottom surface of the iron golf club head, the heel trailing edge 56, and the toe leading edge 58 to the ground. Consequently, when the golf ball to be struck is lying on an irregular ground surface such as deep grass, thick turf, or sand, as is often the case, the potential retarding force exerted by the frictional contact of the sole is smaller than for conventional golf clubs. This description is presented in terms of "potential" contact area and "potential" retarding force, because the actual contact area and retarding force will depend somewhat on the skill of the golfer. However, by reducing the potential contact area and the potential retarding force on the club as it is swung, the present design for an iron golf club head 24 may improve the performance of any golfer, regardless of skill level, by virtue of the design of the club used.

A further advantage of the sole 66 of limited longitudinal extent is that the sole 66 is positioned below the central portion of the front face 36 which strikes the golf ball. Any retarding force will be experienced along the trajectory of the swing of the iron golf club. The resulting retarding force will therefore have little tendency to cause the iron club head body 26 and the club front face 36 to rotate about the shaft 22, leading to a mishit of the golf ball that would send it along a path to either side of the desired path. The central retarding force actually tends to prevent such rotation of the iron club head body 26 and the club front face 36, because the force will increase if such rotation occurs. The sole 66 therefore tends to serve as a "rudder" that encourages the iron club head body 26 and the club front face 36 to retain the desired swing trajectory at the crucial moment just as the club front face 36 impacts the golf ball.

In the preferred case wherein the bottom surface 28 is concavely curved in this region of the sole 66 (FIG. 7), the reduction in potential contact area is even greater, so that the potential retarding force is even smaller. In this case, only the leading edge central sole region 54 and the trailing edge central sole region 60 potentially contact the ground, as the intermediate region between them is recessed slightly.

The present invention has been reduced to practice in a set of golf clubs including no. 1 to no. 9 irons, a pitching wedge, a mid-range pitching wedge, and a sand wedge. The results are generally as described in the preceding three paragraphs. Players who have tested the clubs have confirmed the greater ease in achieving good solid contact with the ball from all types of sand, turf, sod, and divot marks.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A golf club iron having a numerical club head designation number between 2 and 12 inclusive, comprising:

a metallic club head having an iron club head designation number and including a solid metallic club head body having a bottom surface with a heel and a toe, a top surface, and a hosel extending from the club head body at a location adjacent to the heel of the bottom surface and having a hosel axis, there being defined a ground plane perpendicular to the hosel axis;

a front face on the club head body, the front face being inclined at a loft angle to the hosel axis and having a continuously convexly curved lower leading edge along the intersection of the bottom surface and the front face, the lower leading edge extending from the heel to the toe of the bottom surface and including a leading edge inner region adjacent to the heel, a leading edge central sole region, and a leading edge outer region adjacent to the toe; and a lower trailing edge on the club head body, the lower tailing edge having a trailing edge central sole region lying substantially parallel to the leading edge central sole region, there being defined a bottom-tangent plane lying tangent to the leading edge central sole region and to the trailing edge central sole region, a trailing edge inner region tapered upwardly toward the top surface from the trailing edge central sole region toward the heel of the bottom surface, so as to be not parallel with the leading edge inner region, and a trailing edge outer region tapered upwardly toward the top surface from the trailing edge central sole region toward the toe of the bottom surface, so as to be not parallel with the leading edge outer region, the angle measured in degrees between the bottom-tangent plane and the ground plane being about equal in degrees to the club head designation number.

2. The iron of claim 1, wherein the loft angle is from about 17 to about 60 degrees.

3. The iron of claim 1, wherein the width of the bottom surface between the leading edge central sole region and the trailing edge central sole region is no greater than about 1 inch.

4. The iron of claim 1, wherein the length of the bottom surface from the intersection of the trailing edge inner region and the trailing edge central sole region, to the intersection of the trailing edge outer region and the trailing edge central sole region, is from about ¼ inch to about ¾ inch.

5. The iron of claim 1, wherein the club head has a weight of from about 215 to about 305 grams.

6. The iron of claim 1, wherein the bottom surface is concavely curved between the leading edge central sole region and the trailing edge central sole region.

7. The iron of claim 1, further including a shaft affixed to the hosel.

8. A golf club iron, comprising a metallic club head including a solid metallic club head body having a bottom surface with a heel and a toe, a top surface, a hosel extending from the club head body at a location adjacent to the heel of the bottom surface, a front face on the club head body, the front face having a continuously convexly curved lower leading edge along the intersection of the bottom surface and the front face, the lower leading edge extending from the heel to the toe of the bottom surface;

a rear face on the club head body spaced apart from the front face, the rear face having an irregularly convexly curved lower trailing edge along the intersection of the bottom surface and the rear face, the lower trailing edge extending from the heel to the toe of the bottom surface and including a trailing edge central sole region, a trailing edge inner region inclined to the leading edge central sole region by a first trailing edge midpoint acute external angle of from about 10 degrees to about 60 degrees, and a trailing edge outer region inclined to the leading edge central sole region by a second trailing edge midpoint acute external angle of from about 10 degrees to about 60 degrees; and a recess in the rear face of the club head body, there being a rim between the recess and the trailing edge central sole region, the rim having a thickness of from about 5/16 inch to about 1 inch measured at the trailing edge central sole region.

9. The iron of claim 8, wherein a loft angle between an axis of the hosel and the front face is from about 17 to about 60 degrees.

10. The iron of claim 8, wherein the bottom surface has a distance between the leading edge central region and the trailing edge central region of no greater than about 1 inch.

11. The iron of claim 8, wherein the club head has a weight of from about 215 to about 305 grams.

12. The iron of claim 8, wherein the sole region is concavely curved between the leading edge central sole region and the trailing edge central sole region.

13. The iron of claim 8, wherein the length of the bottom surface from the intersection of the trailing edge inner region and the trailing edge central sole region, to the intersection of the trailing edge outer region and the trailing edge central sole region, is from about ¼ inch to about ¾ inch.

14. The iron of claim 8, further including a shaft affixed to the hosel.

15. A golf club iron having a numerical club head designation number between 2 and 12 inclusive, comprising:

a metallic club head having an iron club head designation number and including a solid metallic club head body having a bottom surface with a heel and a toe, a top surface, and a hosel extending from the club head body at a location adjacent to the heel of the bottom surface and having a hosel axis, there being defined a ground plane perpendicular to the hosel axis;

a front face on the club head body, the front face being inclined at a loft angle to the hosel axis and having a continuously convexly curved lower leading edge along the intersection of the bottom surface and the front face, the lower leading edge extending from the heel to the toe of the bottom surface and including a leading edge inner region adjacent to the heel, a leading edge central sole region, and a leading edge outer region adjacent to the toe; and a lower trailing edge on the club head body, the lower tailing edge having a trailing edge central sole region lying substantially parallel to the leading edge central sole region, there being defined a bottom-tangent plane lying tangent to the leading edge central sole region and to the trailing edge central sole region, the trailing edge central sole region having a length of from about ¼ to about ¾ inch, a trailing edge inner region tapered upwardly toward the top surface from the trailing edge central sole region toward the heel of the bottom surface, so as to be not parallel with the leading edge inner region, a trailing edge outer region tapered upwardly toward the top surface from the trailing edge central sole region toward the toe of the bottom surface, so as to be not parallel with the leading edge outer region, and a recess in the rear face of the club head body, there being a rim between the recess and the trailing edge central sole region, the rim having a thickness of from about 5/16 inch to about 1 inch measured at the trailing edge central sole region, the angle measured in degrees between the bottom-tangent plane and the ground plane being about equal in degrees to a club head designation number.

* * * * *